US008934826B2

(12) United States Patent
Schmitt et al.

(10) Patent No.: US 8,934,826 B2
(45) Date of Patent: Jan. 13, 2015

(54) SURFACE TENSION INTERFERENCE COATING PROCESS FOR PRECISE FEATURE CONTROL

(71) Applicant: Xerox Corporation, Norwalk, CT (US)

(72) Inventors: Sandra L. Schmitt, Williamson, NY (US); David J. Gervasi, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 56 days.

(21) Appl. No.: 13/905,555

(22) Filed: May 30, 2013

(65) Prior Publication Data

US 2014/0356538 A1 Dec. 4, 2014

(51) Int. Cl.
*G03G 15/20* (2006.01)

(52) U.S. Cl.
CPC ..... *G03G 15/2053* (2013.01); *G03G 15/2057* (2013.01)
USPC ..... 399/329; 399/333

(58) Field of Classification Search
USPC ..... 399/329, 333; 427/259, 282
See application file for complete search history.

(56) References Cited

U.S. PATENT DOCUMENTS

| | | | | |
|---|---|---|---|---|
| 5,724,638 | A * | 3/1998 | Isogai et al. | 399/333 |
| 6,927,006 | B2 | 8/2005 | Finn et al. | |
| 7,127,205 | B2 | 10/2006 | Gervasi et al. | |
| 7,131,380 | B2 | 11/2006 | Huffer | |
| 8,173,337 | B2 | 5/2012 | Kelly et al. | |
| 2012/0063824 | A1 * | 3/2012 | Schmitt et al. | 399/329 |

FOREIGN PATENT DOCUMENTS

WO 2011066055 6/2011

* cited by examiner

*Primary Examiner* — Sandra Brase
(74) *Attorney, Agent, or Firm* — Simpson & Simpson, PLLC

(57) ABSTRACT

A member useful in printing including a substrate useful in printing, a first coating deposited on the substrate, the first coating having a first surface tension and forming an edge, a second coating deposited on the substrate adjacent the edge of the first coating, the second coating having a second surface tension. The first surface tension is different than the second surface tension. A method for forming a fuser system assembly, the method including: a) depositing a first coating having a first surface tension to form an edge on a substrate; and, b) depositing a second coating having a second surface tension on the substrate adjacent to the edge, the first surface tension is different than the second surface tension.

21 Claims, 5 Drawing Sheets

SURFACE TENSION INTERFERENCE COATING PROCESS FOR PRECISE FEATURE CONTROL

INCORPORATION BY REFERENCE

The following issued patents are incorporated herein by reference in their entireties: U.S. Pat. No. 6,927,006, issued on Aug. 9, 2005, U.S. Pat. No. 7,127,205, issued on Oct. 24, 2006 and U.S. Pat. No. 8,173,337, issued on May 8, 2012.

TECHNICAL FIELD

The presently disclosed embodiments are directed to providing precise feature control for a coating process, and more specifically to providing precise feature control for depositing a coating on a member useful in printing, e.g., a fuser system substrate. Moreover, the presently disclosed embodiments are also directed to providing precise feature control for depositing a coating on a substrate.

BACKGROUND

FIGS. 1 and 2 depict a known printing system which includes a coated fuser system substrate, i.e., a coated fuser roller. Referring to FIG. 1, in a typical electrostatographic reproducing apparatus, a light image of an original image to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of a charger 12 to which a voltage has been supplied from power supply 14. Photoreceptor 10 is then exposed to light from an optical system or an image input apparatus 16, such as a laser and light emitting diode, to form an electrostatic latent image thereon. Generally, the electrostatic latent image is developed by bringing a developer mixture from developer station 18 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to copy sheet 20 by transfer means 22, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 20 advances to fusing station 24, depicted in FIG. 1 as fuser roll 26 and pressure roll 28, although any other fusing components such as a fuser belt in contact with a pressure roll, a fuser roll in contact with pressure belt, and the like, are suitable for use with this apparatus, wherein the developed image is fused to copy sheet 20 by passing copy sheet 20 between fusing roll 26 and pressure roll 28, thereby forming a permanent image. Alternatively, transfer and fusing can be effected by a transfix application.

Photoreceptor 10, subsequent to transfer, advances to cleaning station 30, wherein any toner left on photoreceptor 10 is cleaned therefrom by use of a blade, as shown in FIG. 1, a brush, or other cleaning apparatus.

FIG. 2 is an enlarged schematic view of an embodiment of a fuser member, where fuser roll 26 comprises elastomer surface 32 upon base member 34, e.g., a hollow cylinder or core fabricated from any suitable metal, such as aluminum, anodized aluminum, steel, nickel, copper, and the like, having heating element 36 disposed in the hollow portion thereof which is coextensive with the cylinder. Backup or pressure roll 28 cooperates with fuser roll 26 to form a nip or contact arc 38 through which a copy paper or other substrate 40 passes such that toner images 42 thereon contact elastomer surface 32 of fuser roll 26. As shown in FIG. 2, backup roll 28 has rigid core 44, e.g., a steel core, with elastomeric surface or layer 46 thereon. Sump 48 contains polymeric release agent 50 which may be a solid or liquid at room temperature, but it is a fluid at operating temperatures.

In the embodiment shown in FIG. 2, polymeric release agent 50 is applied to elastomer surface 32 via two release agent delivery rolls 52 and 54 rotatably mounted in the direction indicated. Thus, delivery rolls 52 and 54 are provided to transport release agent 50 to elastomer surface 32. Delivery roll 52 is partly immersed in sump 48 and transports on its surface release agent 50 from sump 48 to delivery roll 54. By using metering blade 56, a layer of polymeric release fluid 50 can be applied initially to delivery roll 54 and subsequently to elastomer 32 in controlled thickness ranging from submicrometer thickness to thickness of several micrometers of release fluid 50. Although the foregoing apparatus is described as including a fuser roller 26, it should be appreciated that the apparatus may include a fuser belt or the like, and such rollers and/or belts include coatings of a variety of types as described infra.

A key issue in various solution or dispersion coating operations, such as the coating deposited on a fuser substrate, is achieving a fine edge detail or border in a finished product. In some products or articles, such as fuser belts composed of flexible substrates, the edge of the finished product can be trimmed. In cases where this is not possible, or where precise coating composition control is desired, a suitable method of directing solution delivery has heretofore been unavailable.

Current methods of belt fabrication, such as belts used in printing systems, involve flow coating of a solvated polymer dispersion which includes a polymer, a crosslinker, filler(s) and optionally other flow agents, surfactants or co-solvents. For example, the base layer may be a silicone polymer. The coating is deposited on a belt substrate arranged on a rotating cylinder or offset cylinder and then kept at a controlled environmental condition, either ambient or within a rotation oven until most of the solvents are evaporated. The belt is then introduced to a higher temperature oven until the coating is crosslinked and any residual solvents or materials are removed. Alternatively, a secondary or tertiary layer is coated upon the substrate, i.e., base layer of the belt, to form a multi-layered article. For example, a release layer may be deposited as a secondary layer.

For fusing components, uniform compression is required for optimal fusing. Current methods of coating result in the area toward the edges where the material ends on the substrate to be much thinner in comparison to the body of the belt. Known coating methods result in the liquid material slowly dropping off and extending past the area which needs to be coated. To try and maximize uniform thickness through the body of the belt, the coating often extends past the desired coating area and then past the maximum width of the belt. Such a layer then cannot be encapsulated in an exterior coating layer, thereby leaving the ends of the substrate exposed which results in oil penetration of the under layer, de-bonding, offset and other early failure modes during the use of the belt. For example, the silicone substrate swells due to exposure to fuser oil thereby causing adhesion issues between the belt and the silicone. Moreover, such swelling may cause the release layer to detach from the silicone substrate. Merely extending the length of the belt is not possible due to hardware constraints.

The results of a known method of coating a belt are depicted in FIG. 3. The known method includes depositing silicone substrate 60 on belt 62. In this method, width 64 of silicone substrate 60 is less than width 66 of belt 62, e.g., the silicone substrate width may be 280 mm while the belt width is 300 mm. By leaving space on each side of silicone substrate 60, e.g., approximately 10 mm on each side, top coating 68, e.g., a release layer, may be deposited thereby encapsulating silicone substrate 60 and providing a barrier against fuser oil exposure, e.g., exposure to a release agent.

It has been found that the use of liquid coatings can result in a variety of problems. For example, when a liquid layer coats a surface, its ends gradually taper off due to surface tension, e.g., ends 70. Such taping precludes the necessary thickness of silicone at the required widths. If the layer is formed having an increased width to provide its required width, sufficient length at the edges is not present for proper encapsulation. For example, if length 72 becomes too small, top coating 68 will not be capable of encapsulating substrate 60. Moreover, in some instances, not only do tapered ends 70 form, but adjacent high points 74 also form. It has been found that the combination of a bump and adjacent tapered portion may comprise as much as 35-36 mm in width. Various methods have been attempted to remove the bumps or raised portions, e.g., using a sanding belt, and such attempts have heretofore failed to properly and effectively remove those portions.

The present disclosure addresses a system and method for applying a coating to a belt wherein the thickness of the coating is maintained across its full width while providing sufficient lengths of uncoated areas on the belt edges to permit full encapsulation thereof by an overcoat layer.

SUMMARY

The present disclosure describes a fabrication process that uses a preliminary or first coating operation that introduces a boundary or border layer of a material having a first surface tension onto a substrate, and subsequently depositing a second coating having a second surface tension. The first surface tension is significantly different than the second surface tension. It should be appreciated that "significantly different" can include but is not limited to differences of approximately 5-10 mN/m, although any difference sufficient to separation between the first and second coating is considered "significantly different". Due to the differences in surface tensions, the second coating is inherently resistant to the first applied coating, thereby making a finished border more easily than other known methods. Flow coating, inkjet deposition or other means of precise application can deposit the first coating, also considered a boundary layer. The secondary coating can be applied via more general coating methods such as spray coating, flow coating or dip coating.

Broadly, the apparatus discussed infra provides a member useful in printing including a substrate useful in printing, a first coating deposited on the substrate, the first coating having a first surface tension and forming an edge, a second coating deposited on the substrate adjacent the edge of the first coating, the second coating having a second surface tension. The first surface tension is different than the second surface tension.

According to aspects illustrated herein, there is also provided a method for forming a fuser system assembly, the method including: a) depositing a first coating having a first surface tension to form an edge on a substrate; and, b) depositing a second coating having a second surface tension on the substrate adjacent to the edge, the first surface tension is different than the second surface tension.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
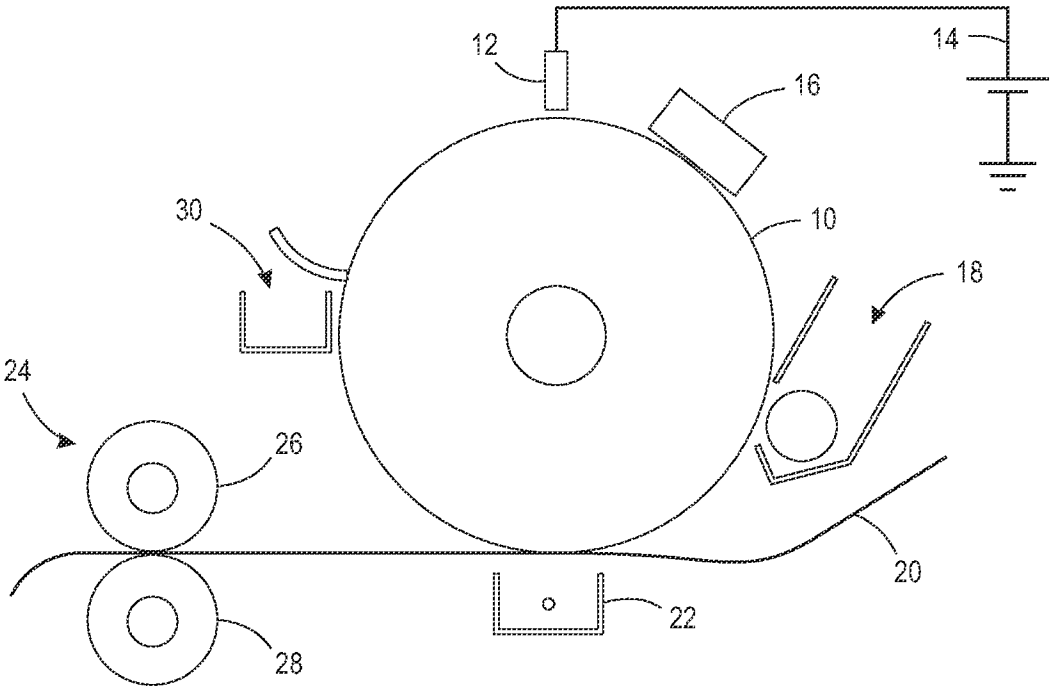
FIG. 1 PRIOR ART
FIG. 1 is a sectional view of a known electrostatographic system.
Figure 2:
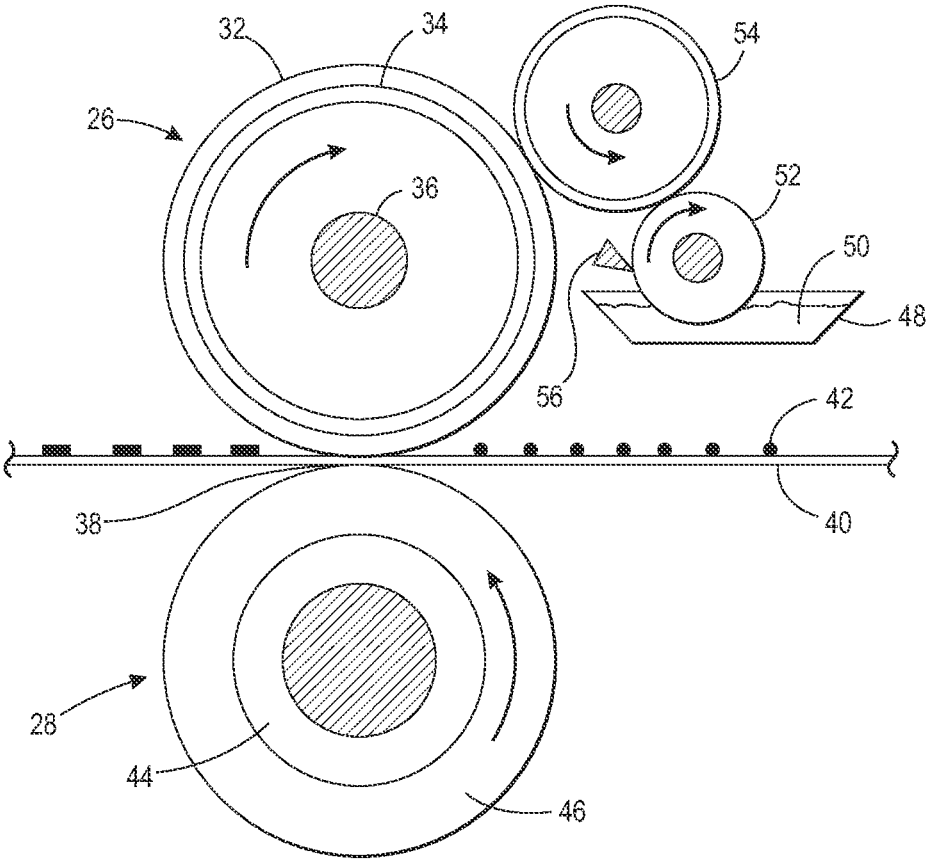
FIG. 2 PRIOR ART
FIG. 2 is a sectional view of a known fuser system, which includes fuser and pressure rollers.
Figure 3:
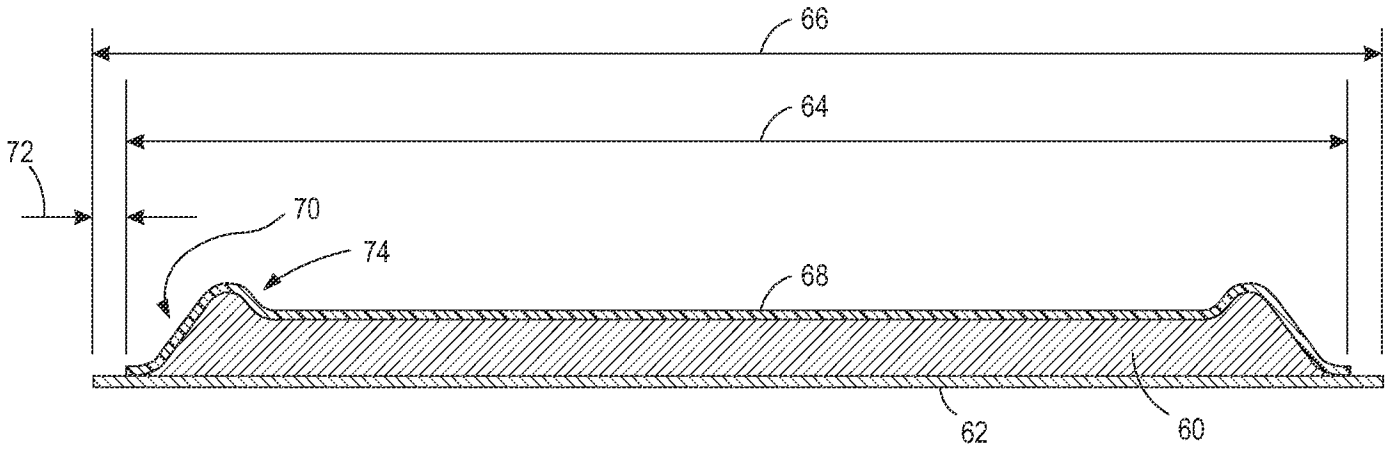
FIG. 3 PRIOR ART
FIG. 3 is a sectional view of a fuser belt having a coating and overcoating deposited thereon via known methods.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, the words "printer," "printer system", "printing system", "printer device" and "printing device" encompasses any apparatus, such as a digital copier, bookmaking machine, facsimile machine, multi-function machine, etc. which performs a print outputting function for any purpose. Additionally, as used herein, "sheet," "sheet of paper," "copy sheet" and "paper" refer to, for example, paper, transparencies, parchment, film, fabric, plastic, photo-finishing papers or other coated or non-coated substrate media in the form of a web upon which information or markings can be visualized and/or reproduced. As used herein, the term 'average' shall be construed broadly to include any calculation in which a result datum or decision is obtained based on a plurality of input data, which can include but is not limited to, weighted averages, yes or no decisions based on rolling inputs, etc.

Moreover, although any methods, devices or materials similar or equivalent to those described herein can be used in the practice or testing of these embodiments, some embodiments of methods, devices, and materials are now described.

The presently disclosed method, in some embodiments, involves a process utilizing preliminary or first coating 76 having a low surface tension to define a geometric feature such as linear edge 78 or other defined pattern edge on a flexible surface, such as non-linear edge 80, which can be deposited as a very thin coating or even a monolayer. In some embodiments, first coating 76 is sacrificial, i.e., coating 76 is removed after the desired coating is formed, or in other words coating 76 is only present for the formation of an edge and is subsequently destroyed. It should be appreciated that as used herein "desired coating" is intended to mean the coating which remains on the fuser substrate, e.g., fuser belt or fuser drum, after the present coating process is completed. First coating 76 is followed by second coating 82, i.e., the desirable coating formulation. It has been found that second coating 82 automatically is 'trained' to an area pre-defined by first coating 76, based on second coating 82 having a higher surface tension than the surface tension of first coating 76. It should be appreciated that although the surface tension of first coating 76 has been described as being lower than the surface tension of second coating 82, the opposite arrangement is also possible, i.e., first coating 76 having a surface tension higher than the surface tension of second coating 82, and such variations are within the spirit and scope of the claims. A surface tension differential must be present between first coating 76 and second coating 82 or the present method cannot be preformed and the present article will not be formed.

Figure 4A:
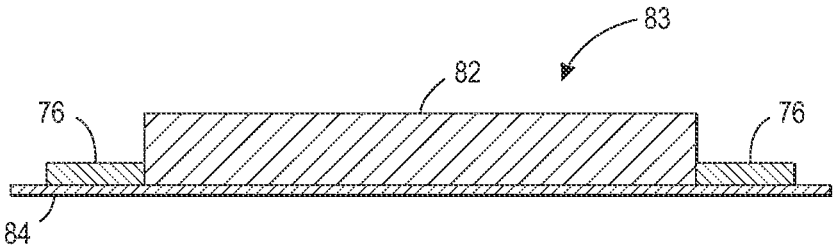
FIG. 4A is a sectional view of a fuser belt including a first coating having a first surface tension and an adjacent second coating having a second surface tension deposited thereon in accordance with the present disclosure.
Figure 4B:
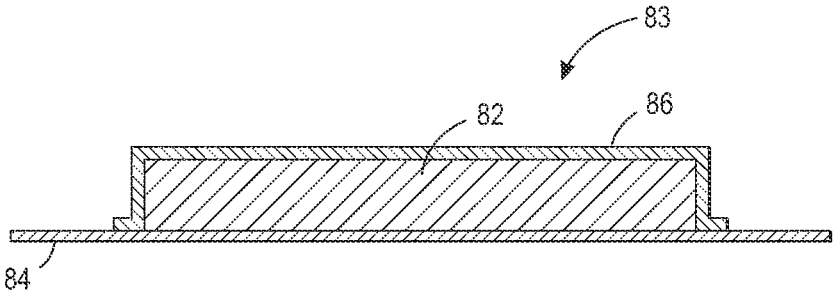
FIG. 4B is a sectional view of the fuser belt of FIG. 4A having the first coating removed therefrom; and, FIG. 5 is a top plan view of a portion of a fuser belt including a first coating having a first surface tension and an adjacent second coating having a second surface tension deposited thereon in accordance with the present disclosure.
Figure 5:
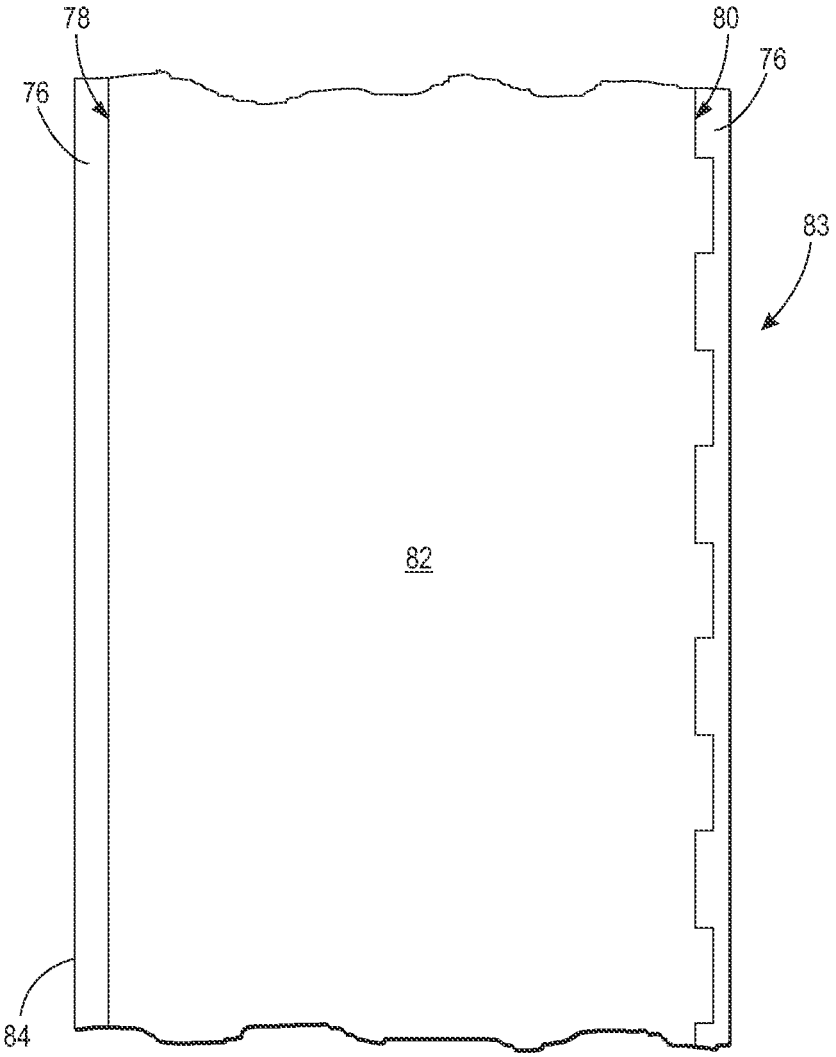

In embodiments where coating 76 is not sacrificial, coating 76 remains on the coated member during subsequent use. As generally depicted in FIG. 4A, the thickness of coating 76 is less than the thickness of coating 82, in some embodiments. In such embodiments, coating 82 forms the portion of fuser belt 83 which contacts the copy paper or other substrate as described supra. Thus, in some embodiments, coating 82 contacts the copy paper or other substrate during a fusing operation, while coating 76 does not contact the copy paper or other substrate.

Fuser belt substrate 84 may be formed from any material commonly known in the art of fuser belts, e.g., a polyimide substrate or a Poly(amide-imide) substrate. First coating 76 may be any suitable coating composition, e.g., a fluorinated polyether such as Fluorolink® S-10 or Krytox®, and fluorosilicone. The foregoing example is appropriate for use in embodiments where first coating 76 has a lower surface tension. First coating 76 may be applied by suitable means known in the art, e.g., brush, spray, print head, nozzle, flow coat, dipping, etc.

Subsequently, second coating 82 is deposited on fuser belt 84. This deposition may be performed by any means known in the art such as flow-coating second coating 82. Second coating 82 may be a silicone formulation, or any other suitable composition, such as fluorosilicone or polyurethane. It should be noted that second coating 82 will not deposit in the area where first coating 76 was applied. The foregoing method causes second coating 82 to successfully entrain its edge to a pre-defined geometrical limit formed by first coating 76. In some embodiments, after second coating 82 is deposited, first coating 76 may be removed.

After the removal of first coating 76, overcoat layer 86 can be deposited over second coating 82 thereby providing a protective barrier for second coating 82. Overcoat layer 86 is typically a fluoroelastomer. Specifically, suitable fluoroelastomers are those described in detail in U.S. Pat. Nos. 5,166,031; 5,281,506; 5,366,772; and, 5,370,931, together with U.S. Pat. Nos. 4,257,699; 5,017,432; and, 5,061,965, the disclosures each of which are incorporated by reference herein in their entireties. As described therein, these elastomers are fluoroelastomers or hydrofluoroelastomers from: (1) a class of copolymers of two of vinylidenefluoride, hexafluoropropylene and tetrafluoroethylene, such as those known commercially as VITON A®; 2) a class of terpolymers of vinylidenefluoride, hexafluoropropylene and tetrafluoroethylene known commercially as VITON B®; or, (3) a class of tetrapolymers of vinylidenefluoride, hexafluoropropylene, tetrafluoroethylene and cure site monomer known commercially as VITON GH® or VITON GF® available from DuPont. Other overcoat materials may also be used such as fluoroplastics, e.g., PFA, PTFE and FEP, and fluoroelastomers, e.g., Solvay-Solexis Tecnoflon®, 3M Dyneon™ and Dailin Dai-el™

As described above, the substrate for a member useful for printing, e.g., a fuser member of a fuser system assembly, may be a roll, belt, film, flat surface or other suitable shape used in the fixing of toner images, such as thermoplastic toner images, to a suitable substrate. It may take the form of a fuser member, and in some embodiments, is in the form of a cylindrical roll, such as the cylindrical roll described above. Typically, in embodiments having a roll fuser member, the substrate takes the form of a cylindrical tube of aluminum, copper, steel or certain plastic materials chosen to maintain rigidity, structural integrity, as well as being capable of having a fluoroelastomer coated thereon and adhered firmly thereto.

The present fabrication process may also be used for other applications aside from fusing components such as fuser belts and fuser drums. For example, the present process is applicable to other coating processes where belt slitting is not a viable option. Moreover, the first coating may be applied by another deposition process such as inkjet or vapor deposition, while the second coating may include conductive material thereby permitting the flow of current through the second coating. As such, the present process is useful in the formation of flexible circuitry or other components where such automatic material boundary layers are desirable.

The present disclosure sets forth a method for creating a predefined edge, border, boundary or pattern to a coating. This is accomplished by applying an initial or first layer of material to precisely define the border or edge that a second, desired coating is intended to follow. The border material, i.e., first coating, is of significantly differing surface tension from the second coating which causes the second coating to resist the boundary material, thus forming a crisp edge. In some embodiments, the first coating may be removed after the second coating is deposited. Furthermore, in some embodiments, an overcoat layer, for example for the protection of the second coating, may be deposited over the second coating forming a complete seal over the second coating.

The present method provides the ability to form a crisp edge in a coating prior to the edge of the substrate being coated. This is of benefit, for example, in the production of multi-layer fuser belts where slitting is not possible. Other more complex geometric features may also be imparted in a coating, as described above. The present invention may also be used in other applications such as forming flexible circuitry.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A member useful in printing comprising:

a substrate useful in printing;

a first coating deposited on the substrate, the first coating comprising a first surface tension and forming an edge;

a second coating deposited on the substrate adjacent the edge of the first coating, the second coating comprising a second surface tension;

wherein the first surface tension is different than the second surface tension.

2. The member of claim 1 wherein the substrate is a roller, a belt, a film or a flat surface.

3. The member of claim 2 wherein the substrate is the roller and the roller is formed from aluminum, anodized aluminum, steel, nickel, copper or a plastic resin.

4. The member of claim 2 wherein the substrate is the belt and the belt is formed from polyimide.

5. The member of claim 1 wherein the first surface tension is less than the second surface tension, or the first surface tension is greater than the second surface tension.

6. The member of claim 1 wherein the first coating is a sacrificial coating.

7. The member of claim 1 further comprising a third coating forming a full seal over the second coating or forming a full seal over the first and second coatings.

8. The member of claim 7 wherein the third coating is a fluoroelastomer or a hydrofluoroelastomer.

9. The member of claim 1 wherein the first coating is a fluorinated polyether.

10. The member of claim 1 wherein the second coating is a silicone.

11. The member of claim 1 wherein the member is a fuser drum or a fuser belt.

12. The member of claim 1 wherein the first coating has a first thickness and the second coating has a second thickness greater than the first thickness.

13. A method for forming a fuser system assembly, the method comprising:

a) depositing a first coating comprising a first surface tension to form an edge on a substrate; and, b) depositing a second coating comprising a second surface tension on the substrate adjacent the edge, the first surface tension is different than the second surface tension.

14. The method for forming a fuser system assembly of claim 13 further comprising:

c) removing the first coating after the step of depositing the second coating.

15. The method for forming a fuser system assembly of claim 14 further comprising:

d) depositing a third coating on the second coating wherein the third coating forms a full seal over the second coating.

16. The method for forming a fuser system assembly of claim 15 wherein the third coating is a fluoroelastomer or a hydrofluoroelastomer.

17. The method for forming a fuser system assembly of claim 13 further comprising:

c) depositing a third coating on the first and second coatings wherein the third coating forms a full seal over the first and second coatings.

18. The method for forming a fuser system assembly of claim 17 wherein the third coating is a fluoroelastomer or a hydrofluoroelastomer.

19. The method for forming a fuser system assembly of claim 13 wherein the first surface tension is less than the second surface tension, or the first surface tension is greater than the second surface tension.

20. The method for forming a fuser system assembly of claim 13 wherein the first coating is a fluorinated polyether.

21. The method for forming a fuser system assembly of claim 13 wherein the second coating is a silicone.

* * * * *